United States Patent [19]

Ashbaugh et al.

[11] Patent Number: 4,894,642

[45] Date of Patent: Jan. 16, 1990

[54] VOICE SECURITY SYSTEM

[75] Inventors: Charles F. K. Ashbaugh; Neal K. Henderson, both of Tampa, Fla.

[73] Assignee: Cyclone Corporation, Tampa, Fla.

[21] Appl. No.: 266,814

[22] Filed: Nov. 3, 1988

[51] Int. Cl.[4] ..... G08B 19/00

[52] U.S. Cl. ..... 340/539; 340/521; 381/110

[58] Field of Search ..... 340/539, 521, 531; 381/110

[56] References Cited

U.S. PATENT DOCUMENTS

| | | | |
|---|---|---|---|
| 4,354,275 | 10/1982 | Bouyssounouse et al. | 340/539 X |
| 4,389,639 | 6/1983 | Torii et al. | 340/539 |
| 4,560,978 | 12/1985 | Lemelson | 340/531 X |
| 4,665,385 | 5/1987 | Henderson | 340/521 X |

FOREIGN PATENT DOCUMENTS

| | | | |
|---|---|---|---|
| 207274 | 2/1984 | German Democratic Rep. | 340/539 |
| 219038 | 12/1984 | Japan | 340/539 |

*Primary Examiner*—Hezron E. Williams
*Assistant Examiner*—Joseph W. Roskos
*Attorney, Agent, or Firm*—Pettis & McDonald

[57] ABSTRACT

An improved voice security system wherein the improvement resides in a non-electrical contact between a remote signalling apparatus and the standard microphone of a two-way radio so that voice transmissions may be accomplished in response to the sensing of a predetermined condition by sensors operatively connected to the remote signalling apparatus. The non-electrical contact is accomplished by the use of a voice and key unit which is electrically connected to the remote signalling apparatus and having a microphone holder mounted thereon whereby the standard microphone physically contacts the housing of the voice and key unit. A speaker is mounted within the voice and key unit housing, and the microphone is modified to include a reed switch which is actuated by a coil placed within the voice and key unit housing whereby, upon applying electrical energy to the coil, the reed switch will close to permit the microphone to transmit audio messages generated by the remote signalling apparatus.

3 Claims, 2 Drawing Sheets

VOICE SECURITY SYSTEM

BACKGROUND OF THE INVENTION

1. Field of the Invention.

The present invention relates to an improved voice security system of the type including a remote signalling apparatus having at least one sensor for detecting a predetermined condition and generating a signal in response to that sensed condition. Logic circuit means are provided for receiving the signal, and a voice synthesizer is provided for generating an audible message in response to the sensed condition. The improvement comprises means for transmitting the audible message to a remote location using a two-way radio having a microphone, but not requiring any electrical connection to the remote signalling apparatus. Without in any way limiting the scope of the present invention, it is contemplated that a primary use for the improved voice security system of this invention will be found by its installation on boats for security purposes when they are left unattended at a dock or harbor facility.

2. Description of the Prior Art.

It is well known that the security and safety of an unattended boat is a matter of some concern to the vessel's owner. Even though boats are often moored at docks or marinas having on-site security, the number of vessels docked at such facilities is often so great as to preclude individual attention to each boat unless its owner chooses to hire a security guard for that vessel. In recognition of the fact that damage from equipment failure, accident or unauthorized boarding can easily take place, a number of safety devices have been developed and are well known for providing some form of remote security.

For example, U.S. Pat. No. 4,593,274 discloses a remote signalling apparatus designed and constructed to provide direct signalling of predetermined events by the actuation of optical and/or acoustic alarm reporting devices. The apparatus taught by that patent also provides for transmitting a signal relating to the occurred event by the use of radio transmissions and/or telephone transmissions. According to the disclosure of the '274 patent, it is particularly useful for installation on a boat so that sensors receive information indicating, for example, flooding, fire, intrusion or other threat, generate a signal, and transmit that signal by radio to a portable receiver carried, for example, by the boat's owner. It should also be noted that according to the disclosure of this patent, both the sensors and the radio transmitter are integral, unitary elements of the apparatus. A functionally similar device is taught in U.S. Pat. No. 4,560,978 to Lemelson. That patent discloses a security system in which information from one or more sensors is converted to synthetic speech and then transmitted by radio to one or more portable receivers. As with the '274 patent, the radio transmitter of the Lemelson system is an integral part of the apparatus, and requires the use of a remote receiver corresponding to the frequency of the radio means.

Yet another similar security system is disclosed in U.S. Pat. No. 4,652,859 to Van Wienen. According to the disclosure of the patent, it provides an alarm system for monitoring alarm conditions and for generating signals responsive thereto. Signals from the various sensors are communicated to a master control where the signal is processed to generate an alert signal which may be transmitted by radio to portable receivers. As with the devices in the two patents discussed above, the radio transmitter and the remote receivers are integral to the Van Wienen system and specifically configured to function therewith.

U.S. Pat. No. 4,622,539 to Buss, et al., discloses an alarm system incorporating a speech synthesizing circuit for generating a verbal alarm message to be broadcast in the event of an alarm signal. U.S. Pat. No. 4,363,031 to Reinowitz discloses a wireless alarm system whereby various threat alarms are connected to a transmitter for sending an alarm signal to a radio receiver.

Finally, U.S. Pat. No. 4,651,157 to Gray, et al., discloses a security system intended for use on marine vessels and incorporating tracking information by utilization of LORAN-C transmitters.

Other security devices for monitoring predetermined conditions and providing a signal upon a predetermined change of the monitored condition are well known in the patent literature. Such devices include relatively simple, home-type smoke detectors as well as more sophisticated devices incorporating automatic telephone dialers and audible messages for contacting fire departments and/or police departments. Examples of such devices known to these applicants include the following U.S. Pat. Nos.:

| | |
|---|---|
| U.S. Pat. No. 3,553,377 | U.S. Pat. No. 3,710,313 |
| U.S. Pat. No. 4,092,643 | U.S. Pat. No. 4,371,751 |
| U.S. Pat. No. 4,375,637 | U.S. Pat. No. 4,455,551 |
| U.S. Pat. No. 4,550,311 | U.S. Pat. No. 4,558,181 |
| U.S. Pat. No. 4,716,582. | |

Without in any way seeking to minimize or question the importance or utility of any of the above prior art security devices, it is clear that all of the systems incorporating means for transmitting an audible message in response to a sensed condition require the use of what might accurately be termed a hard-wired transmitter, and a receiver especially designed and configured for that system's transmitter. It is, therefore, apparent that there is a great need in the art for a security device capable of transmitting a voice message, but also constructed to utilize a standard, two-way radio of the type normally found on vessels requiring such security systems. It is also desirable that any such security system not interfere with the normal operation of the two-way radio for standard (that is, non-security) transmissions.

SUMMARY OF THE INVENTION

The Improved Voice Security System of this invention utilizes a state-of-the-art remote signalling apparatus having at least one sensor for detecting a predetermined condition and generating a signal in response to that sensed condition. The signalling apparatus includes logic circuit means for receiving the signal, and voice synthesizer means for generating an audible message in response to the sensed condition. This invention is characterized by the improvement comprising means for transmitting the audible message to a remote location utilizing a two-way radio having a microphone. While a preferred utility for the improved voice security system of this invention would involve its installation on a boat or other motor vessel, the scope of the invention is not to be limited thereto. The improved voice security system is uniquely characterized by its utilization of a voice and key unit interposed between the remote signalling apparatus and the radio microphone whereby the voice message may be transmitted over the radio without the necessity of direct electrical contact between the remote signalling apparatus and the radio, and without interfering with normal use of the radio independent of the remote signalling apparatus.

According to a preferred embodiment of the improved voice security system, one or more sensors for detecting conditions such as a flood, fire, or an unauthorized intrusion would be located at appropriate points on the vessel. These sensors are electrically connected to logic circuit means and voice synthesizer means whereby an audible message is generated in response to a particular sensed condition and electrical transmission of that audible message is controlled by the logic circuit. In order to transmit the audible message from the vessel, a voice and key unit is interposed between the remote signalling apparatus and the microphone of a standard, two-way radio.

The voice and key unit comprises a housing having a high density conducting speaker mounted therein. The speaker is electrically connected to the remote signalling apparatus so as to permit transmission of the audible message through the speaker. A microphone hanger is mounted to the exterior of the voice and key unit housing opposite the primary radiating surface of the speaker. It has been found that the microphone holder disclosed in U.S. Pat. No. 4,088,848 to Weed is particularly suitable for use in this preferred embodiment of the improved voice security system. It is well known that virtually every two-way radio microphone includes a mounting button on the back of the microphone whereby it may be placed in a holder such as that disclosed in the Weed patent.

We have found the Weed holder to be particularly suitable, for it provides an extremely firm, physical contact with not only the microphone button but also at least a portion of the microphone body. Thus, mechanical vibration from the speaker within the voice and key unit housing is readily transmitted through the housing, to the microphone holder, and directly to the microphone itself.

The voice and key unit further comprises a key means whereby the microphone may be automatically actuated to permit transmission of the audible message when the microphone is attached to the voice and key unit by its mounting bracket. The key means comprises a coil mounted inside the unit housing, that coil being electrically connected to the signalling apparatus so that it will be energized to create a magnetic field whenever any one sensor detects a predetermined condition for generating an audible message. The key means further comprises a switch means responsive to the magnetic field mounted within the microphone, whereby the microphone will automatically permit transmission of the audible message by response of the switch means to the magnetic field created by the coil.

Obviously, then, because the audible message is being transmitted by a standard radio transmitter, it may be received by any similar transceiver.

While the remote signalling apparatus utilized in the improved voice security system of this invention may be of any well known construction, attention is invited to the following description of a preferred such remote signalling apparatus. As previously indicated, one or more sensors capable of detecting predetermined "alarm" conditions are disposed at appropriate locations on the vessel. Each of the sensors is electrically connected to a main unit including logic circuitry and voice synthesizer means. The main unit would also preferably include resident memory, emergency power supply in the event of an electrical failure, and appropriate controls and display panels for arming the apparatus. Resident memory of the random access type would also be included so that the audible message to be transmitted would correspond to the predetermined condition sensed. Inasmuch as utilization of the improved voice security system of this invention would necessarily result in radio transmission, part of the logic circuitry of the system's main unit would include timing devices so that the radio transmissions would satisfy appropriate government regulations and not "jam" the transmitting frequency. In this preferred embodiment, the main unit permits the operator to record predetermined audible messages, and to vary those messages from time to time. Also, in this preferred embodiment, regardless of the condition sensed, each transmission would include appropriate data concerning the identity of the vessel and its location.

As indicated above, the voice and key unit is designed to interface the voice message from the signalling apparatus with the owner's radio transmitter. The transmit command is accomplished with the aid of a small modification to the radio microphone. The microphone back is removed and a small magnetic reed switch is secured along the back of the microphone shell. The two leads of the switch are electrically connected across the push-to-talk switch in the microphone, and the microphone is then reassembled and hung on the bracket mounted on the exterior of the voice and key unit housing. When the signalling apparatus is actuated by any one of the sensors, the magnetic coil mounted within the voice and key unit housing is energized to create a magnetic field which will close the reed switch mounted within the microphone body. Then, the audible message is passed to the microphone not by the usual route of sound waves and air, but through the back of the microphone by the same principle as bone conduction. Actual use of the improved voice security system of this invention confirms that audio quality is excellent with about the same fidelity as when the microphone is used to transmit the human voice.

From this brief description of the improved voice security system, it is immediately apparent that an extremely economical security system is provided, for it utilizes the standard radio transceiver found on most boats today. The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawing.

DETAILED DESCRIPTION

Figure 1:
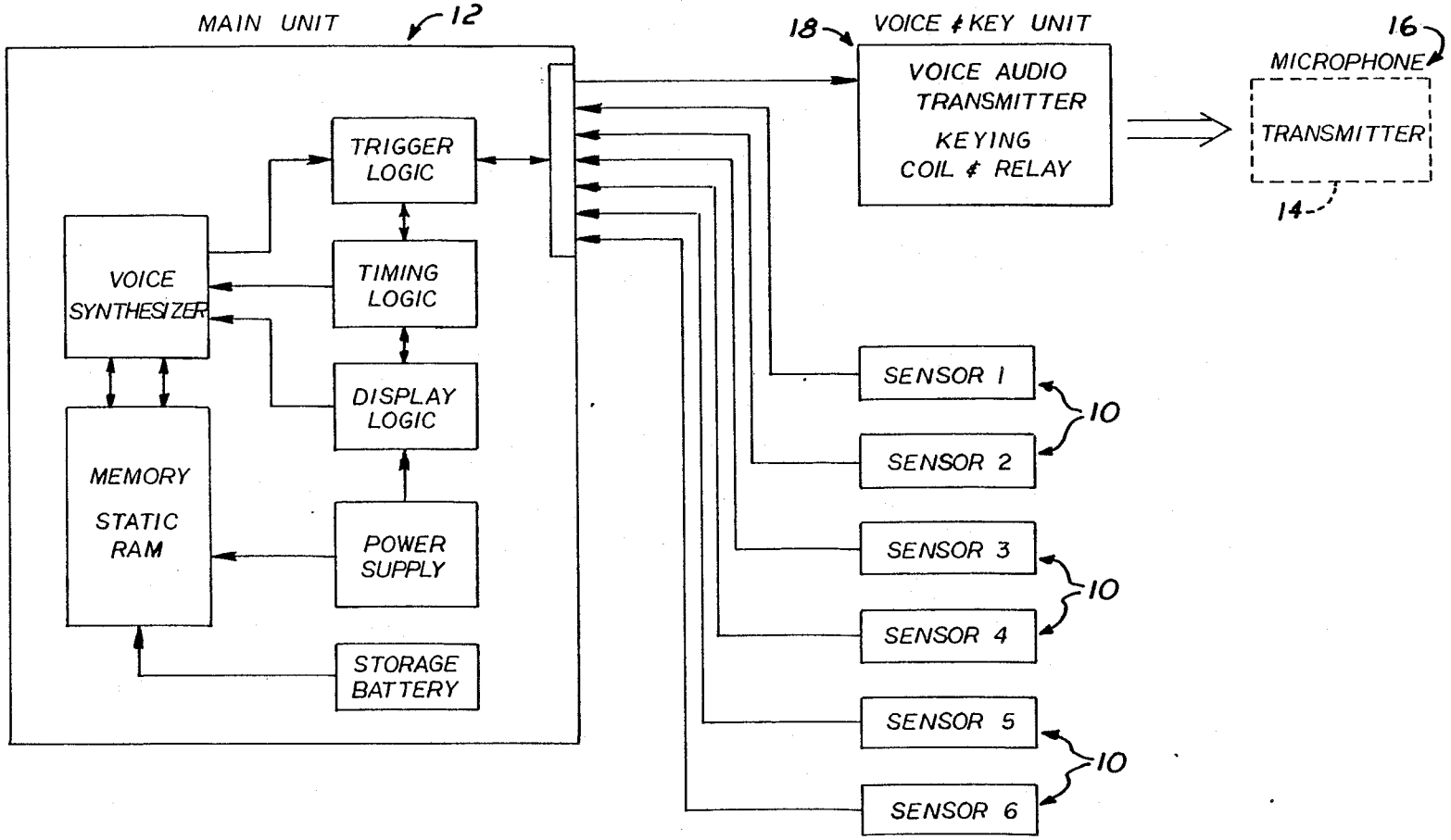
FIG. 1 is a schematic representation of the improved voice security system of this invention.

The improved voice security system of this invention is schematically represented in the view of FIG. 1. In the remainder of this detailed description, the improved voice security system will be described as if installed on a boat, but it is to be understood that the scope of the invention is not to be limited thereby. It is also to be understood that the sensors, generally indicated as 10, and the main unit, generally indicated as 12, are considered to be state-of-the-art. While sensors 10 and main unit 12 are necessary for the utility of the improved voice security system, the scope of this invention resides in the means for transmitting audible messages to a remote location utilizing a two-way radio transmitter 14 having a microphone generally indicated as 16, and the means for transmitting being identified as a voice and key unit generally indicated as 18. As shown in FIG. 1, each of the sensors 10 is electrically connected to main unit 12 so as to provide a signal to main unit 12 upon actuation of any one or all of the sensors 10. As a direct result of the incoming alarm signal from one of the sensors 10, main unit 12 processes the alarm signal to generate a predetermined audible message in response to the particular alarm condition sensed. The audible message is then electrically transmitted to voice and key unit 18 for ultimate radio transmission through microphone 16 to transmitter 14. Inasmuch as the improvement of this invention resides in voice and key unit 18, attention is now invited to the views of FIGS. 2 and 3 wherein structural details of the voice and key unit 18 are presented.

Figure 2:
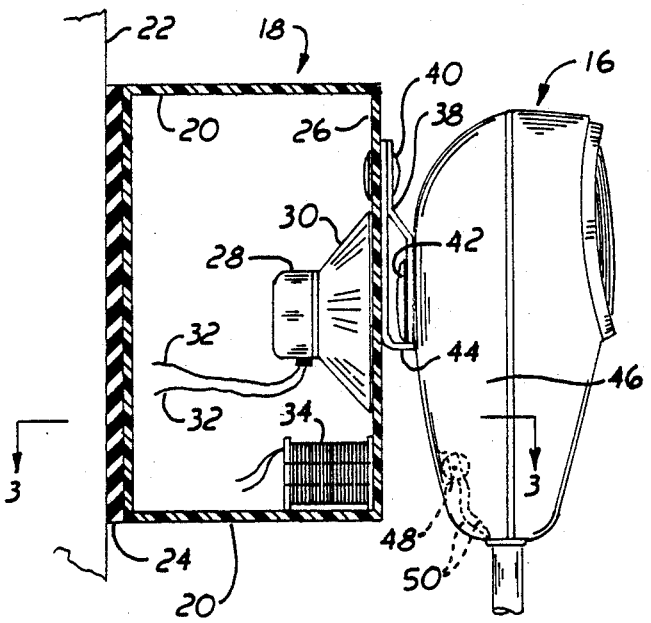
FIG. 2 is a detailed view, partially in section, of the voice and key unit of this invention.

Referring first to the view of FIG. 2, it can be seen that voice and key unit 18 includes a housing 20. Housing 20 is attached to any suitable support surface 22, and a layer of resilient material such as, for example, rubber 24, is interposed between housing 20 and support surface 22 so as to reduce any transmission of mechanical vibration from surface 22 to housing 20.

Mounted within housing 20 and adjacent a wall 26 thereof is a speaker 28. While the specific construction of speaker 28 is not deemed critical, it is important that its primary sound-transmitting element 30 be adjacent wall 26 of housing 20. Speaker leads 32 are electrically connected to main unit 12 for reception and reproduction of the audible alarm message.

Also mounted within housing 20 substantially adjacent wall 26 is coil 34. Coil leads 36 are also electrically connected to main unit 12 whereby coil 34 will be energized to create a magnetic field upon actuation of main unit 12 in response to any one of the sensors 10.

As seen in the view of FIG. 2, a microphone bracket 38 is attached to housing 20 on the exterior surface of wall 26, substantially opposite the primary sound-transmitting element 30 of speaker 28. Microphone bracket 38 may be attached to wall 26 by any suitable fastening means such as, for example, rivet 40. As described above, microphone bracket 38 is of known construction dimensioned and configured to retain microphone 16 therein by receiving microphone button 42. In addition to positively contacting microphone button 42 as shown in the view of FIG. 2, it is to be observed that lower leg 44 of bracket 38 also contacts shell body 46 of microphone 16. By virtue of the direct, physical contact of speaker 28 to wall 26, of wall 26 to bracket 38, and of bracket 38 to body 46 of microphone 16, the audible message produced by speaker 28 is transmitted to microphone 16 not through the air but by the same principle as bone conduction.

Figure 3:
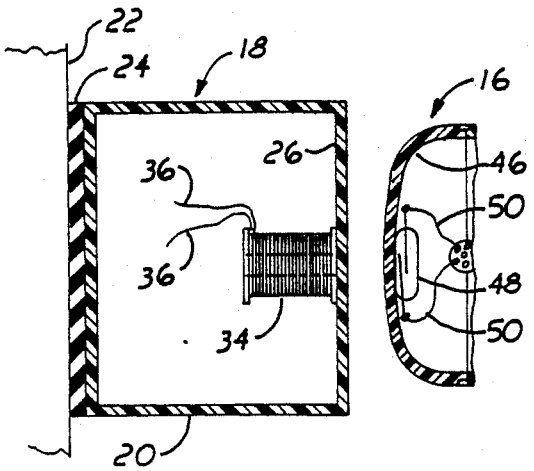
FIG. 3 is a sectional view taken along line 3—3 of FIG. 2.

Referring to the sectional view of FIG. 3, it can be seen that a reed switch 48 is mounted within microphone body 46 so as to be in opposed relation to coil 34 when microphone 16 is placed within the bracket 38. The switch leads 50 are electrically connected to the push-to-talk button (not shown) of microphone 16. Reed switch 48 is responsive to the magnetic field created by coil 34 so that energizing coil 34 will cause switch 48 to close, permitting microphone 16 to transmit the audible message from speaker 28 through transmitter 14. It is of course to be understood that switch leads 50 are connected in parallel fashion to the push-to-talk button of microphone 16 so that microphone 16 and transmitter 14 will operate normally and independently from the improved voice security system of this invention.

Thus, by virtue of the present invention, an owner may provide a voice security system capable of being received by virtually any transceiver without the necessity of purchasing or installing a transmitter uniquely dedicated to the security system. For example, a boat owner could dock his vessel in a foreign port, go miles inland with a VHF portable radio, and have his vessel's security system call him and state the nature of an emergency in plain language. Furthermore, it can be appreciated that the improved voice security system of this invention does not require the receiving radio to incorporate any special equipment in order to monitor the system properly. Since the audible transmission will identify the vessel and the nature of the emergency in plain language, the standard VHF transceiver found in every dockmaster's office is already capable of monitoring literally an entire fleet of vessels equipped with this security system. Even vessels at anchor can be efficiently monitored from the dockmaster's office. Vessels can travel from location to location and maintain maximum protection simply by selecting the appropriate monitored channel for their location.

It is also to be remembered that the improved voice security system of this invention is applicable for use in other than marine applications. For example, farmers may be interested in utilizing a business band VHF monitoring system to provide security and safety over silos or other buildings in remote locations. The improved voice security system of this invention is imminently suitable for such applications.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An improved voice security system of the type including a remote signalling apparatus having at least one sensor for detecting a predetermined condition and generating a signal in response to a sensed condition, logic circuit means for receiving the signal, and voice synthesizer means for generating an audible message in response to the sensed condition wherein the improvement comprises means for transmitting the audible message to a remote location utilizing a two-way radio having a microphone, said means comprising a voice and key unit interposed between said voice synthesizer and said microphone of said two way radio.

2. An improved voice security system as in claim 1 wherein said voice and key unit comprises a housing, a speaker mounted inside said housing, said speaker being connected to the voice synthesizer means; a microphone bracket attached exteriorly of said housing and adjacent said speaker for receiving the microphone therein; and key means electrically connected to the remote signalling apparatus and to the microphone whereby the microphone is automatically actuated by the signalling apparatus to permit transmission of the audible message when the microphone is attached to said voice and key unit by said bracket.

3. An improved voice security system as in claim 2, wherein said key means comprises a coil mounted inside said housing, said coil being electrically connected to said signalling apparatus whereby said coil will be energized to create a magnetic field whenever any of the at least one sensors detects a predetermined condition; said key means further comprising a switch means mounted within the microphone, said switch means being responsive to said magnetic field, whereby the microphone will automatically permit transmission of the audible message generated by the signalling apparatus.

* * * * *